US005430758A

United States Patent [19]

Gillhaus

[11] Patent Number: 5,430,758

[45] Date of Patent: Jul. 4, 1995

[54] MAGNETIC YOKE FOR AN INDUCTION CRUCIBLE FURNACE

[75] Inventor: Horst Gillhaus, Dortmund, Germany

[73] Assignee: ABB Patent GmbH, Mannheim, Germany

[21] Appl. No.: 40,127

[22] Filed: Mar. 30, 1993

[30] Foreign Application Priority Data

Mar. 30, 1992 [DE] Germany ..... 42 10 374.6

[51] Int. Cl.[6] ..... H05B 6/22

[52] U.S. Cl. ..... 373/153; 373/152; 373/154

[58] Field of Search ..... 373/138, 151, 152, 153, 373/154

[56] References Cited

U.S. PATENT DOCUMENTS

| | | | |
|---|---|---|---|
| 1,827,274 | 10/1931 | Willcox | 373/154 |
| 3,704,336 | 11/1972 | Synnestuedt | 373/153 |
| 5,247,539 | 9/1993 | Gillhaus | 373/153 |

FOREIGN PATENT DOCUMENTS

| | | |
|---|---|---|
| 102802 | 12/1973 | German Dem. Rep. . |
| 297229 | 1/1992 | German Dem. Rep. . |
| 968717 | 3/1958 | Germany . |
| 1089493 | 9/1960 | Germany . |
| 977483 | 9/1966 | Germany . |
| 2405597 | 8/1974 | Germany . |
| 2909251 | 8/1980 | Germany . |
| 376660 | 7/1932 | United Kingdom . |
| 1451287 | 9/1976 | United Kingdom . |

OTHER PUBLICATIONS

"Mittelfreqenz-Induktions-Tiefenanlagen Typ ITMK", D ME/D 1182 89 D, pp. 1-8.

"Mittelfrequenz-Induktions-Tiefegelofenanlage", ABB, P. 1-8.

*Primary Examiner*—Bruce A. Reynolds
*Assistant Examiner*—Tu Hoang
*Attorney, Agent, or Firm*—Herbert L. Lerner; Laurence A. Greenburg

[57] ABSTRACT

An induction crucible furnace has a furnace axis and a furnace coil generating magnetic flux. A magnetic yoke for the furnace includes a barlike lamination packet for guiding the magnetic flux. The lamination packet has a middle region and two lateral regions being adjacent the middle region and having borders facing away from the middle region. The lamination packet has a number of individual single laminations having edges and being electrically insulated from one another. The lamination packet has a main surface facing the furnace coil with a shape being sectioned into three parts for positioning the middle region relatively close to the furnace coil and defining a distance between the edges of the individual laminations and the furnace coil being increased in the two lateral regions toward the borders. Two peripheral regions face toward the furnace coil and have acute-angled, lamination-free sectors being parallel to the furnace axis.

14 Claims, 2 Drawing Sheets

MAGNETIC YOKE FOR AN INDUCTION CRUCIBLE FURNACE

BACKGROUND OF THE INVENTION

1. Field of the Invention

The invention relates to a magnetic yoke for an induction crucible furnace, having a barlike lamination packet which is suitable for guiding magnetic flux generated by the furnace coil of the induction crucible furnace and which includes a number of individual single laminations being electrically insulated from one another.

Such a magnetic yoke for an induction crucible furnace is known from a publication entitled ABB-Druckschfirt [ABB Publication]No. D ME/D 118289 D. The induction crucible furnace is suitable for inductive melting of cast iron, steel, light metal, heavy metal and alloys. When constructed as a medium-free induction crucible furnace, its operation takes place at frequencies of 125 to 1000 Hz, for example. A power converter is used to establish an alternating voltage at a given frequency.

The active part of the induction crucible furnace is the furnace coil which has an interior that sheathes a ceramic crucible. The alternating current flowing through the furnace coil produces a magnetic alternating field, which is carried through the metal starting material (melt) inside the furnace crucible and is carried through the iron lamination packets of the magnetic yokes outside the coil.

The magnetic alternating field induces eddy currents in the metal starting material, or in other words electrical energy that is converted into heat. According to the transformer principle, the furnace draws power from the power supply, so that with energy being delivered continuously, the starting material is made to melt. The electromagnetic forces acting upon the melt cause an intensive motion in the bath, which assures a rapid equalization in terms of heat and mass.

The magnetic yokes are disposed on the outside of the coil, in the form of individual single packets that are distributed parallel to the furnace axis over the periphery of the coil, with interstices between them. Each single packet includes a number of thin transformer laminations being electrically insulated from one another and having a high specific electrical resistance and high permeability. The iron lamination packets of the magnetic yokes serve the purpose of carrying the magnetic alternating flux, as already noted above. The intent is to afford the magnetic flux a path of low magnetic resistance, which at the same time causes only slight eddy current losses. Due to the use of the magnetic yokes, as a consequence of the reduction in magnetic resistance in the yoke region of the flux, the unavoidable reactive power is lessened. At the same time, the flux is kept from entering the usually ferromagnetic, load-bearing outer components of the furnace (furnace body with lining), thereby preventing its being heated by eddy currents.

It has been found that aside from the eddy current losses, which are caused by the magnetic alternating field extending predominantly parallel to the laminations, additional, sometimes considerable locally limited eddy current losses also occur at certain points of the lamination packets. In the interstice between the oven coil and the melt and also in the region of the penetration depth of the magnetic alternating field into the melt, the magnetic resistance is constant along the coil periphery, or in other words in the azimuth direction. Accordingly, the flux densities along the coil periphery are also constant, and the field lines all run parallel to the furnace axis.

Conversely, in the above-described configuration of the magnetic yokes on the coil periphery, regions of low magnet resistance alternate with regions of high magnetic resistance (lamination packets and interstices) in the yoke space of the field on the outside of the furnace coil. For the flux, regions of high magnetic conductance are accordingly connected parallel to those of very low conductance. Thus in the outer region of the coil, the flux finds its way largely through the regions of high conductance, or in other words it is carried virtually exclusively in the lamination packets.

However, at the upper and lower ends of the coil or lamination packet it propagates not only radially in the direction of the middle of the crucible (normal field), but also circumferentially of the coil, or in other words largely horizontally (transverse field), and then the interior of the coil changes into a circumferentially uniform flux density. In other words, some of the flux at the end region of the lamination packets emerges from the packets transversely to the plane of the laminations. As a result, considerable additional eddy current losses in the end region of the lamination packets are produced, which can lead to local overheating of the lamination packets and cover plates. If the power is high enough, then separate, expensive additional cooling provisions are necessary at those points.

It is accordingly an object of the invention to provide a magnetic yoke for an induction crucible furnace, which overcomes the hereinafore-mentioned disadvantages of the heretofore-known devices of this general type and in which spot induction at high specific power is prevented.

SUMMARY OF THE INVENTION

With the foregoing and other objects in view there is provided, in accordance with the invention, in an induction crucible furnace having a furnace axis and a furnace coil generating magnetic flux, a magnetic yoke, comprising a barlike lamination packet for guiding the magnetic flux, the lamination packet having a middle region and two lateral regions being adjacent the middle region and having borders facing away from the middle region, a number of individual single laminations having edges and being electrically insulated from one another, and a main surface facing the furnace coil, the main surface having a shape being sectioned into three parts for positioning the middle region relatively close to the furnace coil and defining a distance between the edges of the individual laminations and the furnace coil being increased in the two lateral regions toward the borders; and two peripheral regions facing toward the furnace coil and having acute-angled, lamination-free sectors being parallel to the furnace axis.

The advantages attainable with the invention are in particular that the temperature distribution within the magnetic yoke is optimized. In other words, it particularly prevents locally high temperatures from being generated in the lamination packets or the support body (overheating). The formation of leakage fields is reduced to a great extent and a uniform exploitation of the lamination packet section in terms of the losses and temperatures that arise is assured, and the losses are reduced overall. Since the magnetic yoke no longer needs to be constructed while taking special account of the zones having a high induced specific spot power (while other zones hardly serve to carry the magnetic flux and therefore remain cold) and because of the reduction in losses, the required cross section of the lamination packet becomes smaller overall, with the advantageous result of economies in terms of material, weight and cost.

In accordance with another feature of the invention, the lamination packet has three main surfaces not facing toward the furnace coil, and there is provided a supporting body clasping the three main surfaces and having a C or U-shaped cross section.

In accordance with a further feature of the invention, the supporting body has two side walls and a back wall, the back wall is sectioned into one middle part and two side parts, the side parts have oblique surfaces with increased distances from the furnace coil toward the side walls, and each of the side parts form an acute angle, preferably of 45°, with a respective one of the side walls.

In accordance with an additional feature of the invention, the middle part of the back wall of the supporting body has a cylindrically curved inner surface in contact with the lamination packet, the inner surface having a radius being adapted to the radius of the furnace coil.

In accordance with yet another feature of the invention, there are provided insulating blocks formed of an electrically insulating material, each of the side walls of the supporting body having a device for securing one of the insulating blocks.

In accordance with yet a further feature of the invention, the insulating blocks secured to the side walls of the supporting body project beyond the lamination packet and define a drainage distance between the furnace coil and the lamination packet with the yoke pressed against the furnace coil.

In accordance with yet an added feature of the invention, the supporting body is formed of a material with good electrical conductivity, such as aluminum or an aluminum alloy.

In accordance with again another feature of the invention, the supporting body has at least one longitudinal conduit formed therein, such as for carrying a coolant.

In accordance with again an added feature of the invention, the supporting body is constructed in one piece.

In accordance with again an additional feature of the invention, the supporting body includes at least one extrusion molded profile.

In accordance with a concomitant feature of the invention, the supporting body is deflection and torsion-resistant.

Other features which are considered as characteristic for the invention are set forth in the appended claims.

Although the invention is illustrated and described herein as embodied in a magnetic yoke for an induction crucible furnace, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
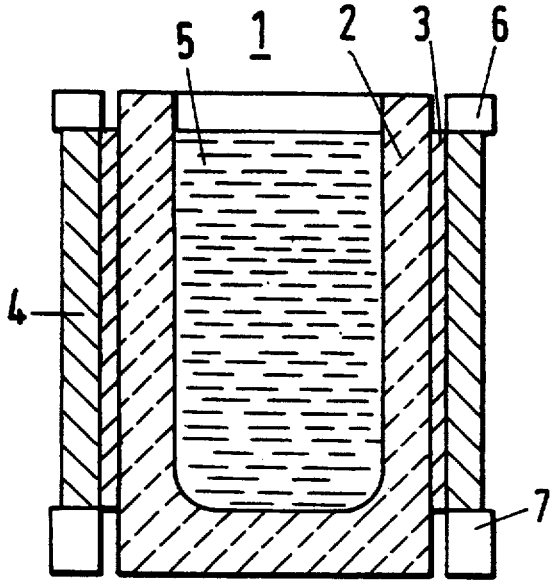
FIG. 1 is a diagrammatic, lateral-sectional view of an induction crucible furnace.

Referring now to the figures of the drawing in detail and first, particularly, to FIG. 1 thereof, there is seen an induction crucible furnace 1 in a lateral section. The induction crucible furnace 1 includes a fireproof, preferably ceramic, cylindrical crucible 2 that is closed at the bottom and open at the top, a cylindrical coil 3 wrapping around the crucible 2, and a plurality of magnetic yokes 4, which are constructed in the form of individual bars disposed parallel to the furnace axis on the outer jacket surface of the coil. A melt (that is, molten metal starting material) in the interior of the crucible 2 is identified by reference numeral 5. The individual barlike magnetic yokes 4 are pressed against the furnace coil 3 by means of respective upper and lower frames 6 and 7. These frames 6, 7 are part of a non-illustrated supporting furnace body.

Figure 2:
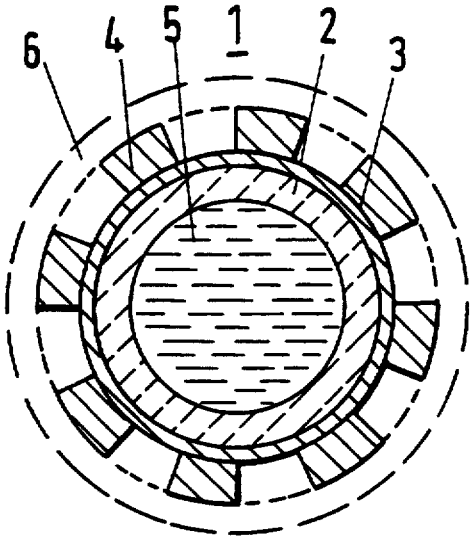
FIG. 2 is a plan view of an induction crucible furnace.

FIG. 2 is a plan view of an induction crucible furnace 1 with the crucible 2, the melt 5, the furnace coil 3, the individual barlike magnetic yokes 4 and the upper frame 6. In FIG. 2, the frame 6 is annular in structure, although it may also be square in shape, for example. Interstices are located between the individual magnetic yokes 4. The actual supporting furnace body is not shown, for the sake of simplicity.

Figure 3:
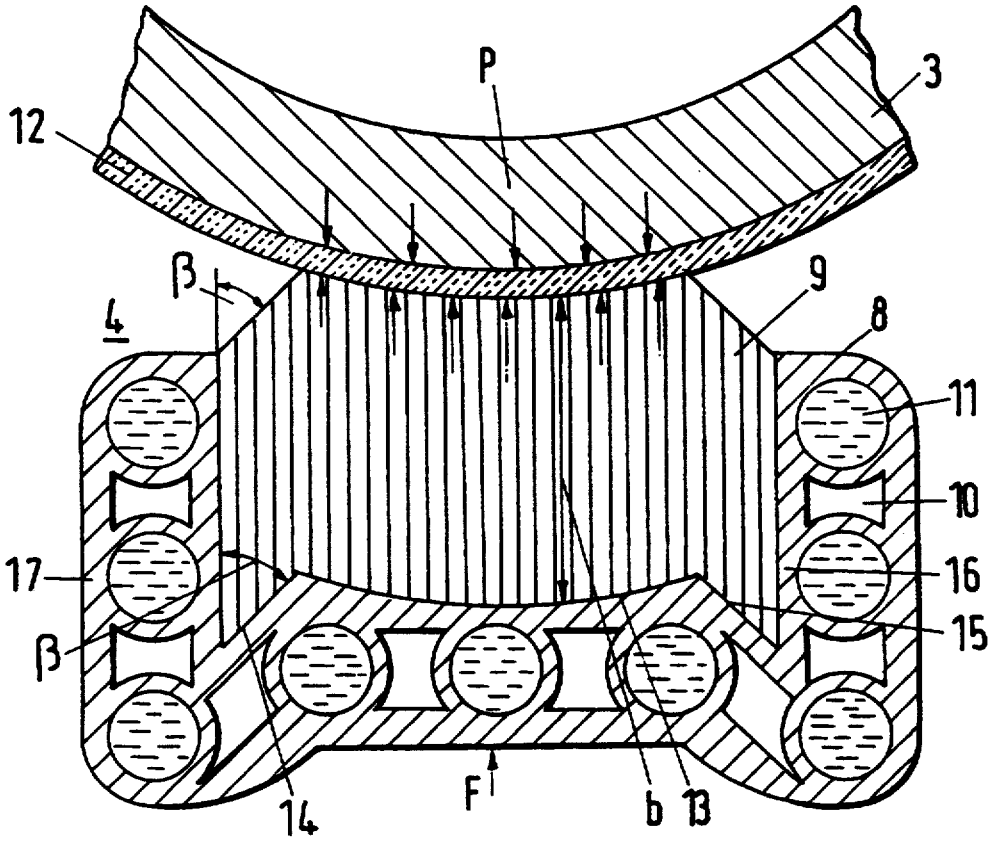
FIG. 3 is a fragmentary, sectional view of a first fundamental embodiment of a magnetic yoke.

FIG. 3 shows a first fundamental embodiment of a magnetic yoke in section. It can be seen that an active lamination packet 9 is clasped in the form of a C or a U by a one-piece supporting body 8 (including a back wall with two side walls). The supporting body 8 is suitably constructed as an extrusion-molded profile, which is preferably made of an aluminum alloy and has the advantage of high electrical conductivity. The lamination packet 9 includes a number of individual single laminations that are electrically insulated from one another.

The supporting body 8 has a plurality of individual longitudinal conduits 10 formed therein, so that the extruded profile in cross section forms a lattice system with a high number of longitudinal voids. This assures high rigidity against bending and torsion while using comparatively little starting material and having a low material weight and low material cost. In addition, high damping of the radial vibrations, which are transmitted to the furnace body from the furnace coil 3 through the magnetic yokes 4 and the frames or frame rings 6, 7, is attained. At least some of the longitudinal conduits may be used as internal cooling conduits 11 for the circulation of a coolant, so that because of the large heat transfer surface area, a high capacity for dissipation of heat is brought about for the eddy current heat losses occurring in the lamination packets during operation.

Depending on the heat transfer surface area that is necessary, one, two, three or more longitudinal conduits may be used as coolant conduits. This assures that the temperature of the lamination packets will be kept within allowable limits. Water may serve as a coolant, for example. It is unnecessary to use separate cooling devices that have to be put into direct heat-conducting contact with the lamination packets.

Pressing the magnet yoke 4 against the furnace coil 3 is carried out by the active lamination packet 9. In order to permit each single lamination of the lamination packet 9 to be of the same width b (which simplifies the manufacture of the magnetic yoke and makes it less expensive), a middle part 13 of the back wall of the supporting body 8 is cylindrically curved on its inner surface that contacts the lamination packet, and the radius of the cylinder is adapted to the radius of the furnace coil 3. An electrical insulation 12, which is preferably formed of some material that does not store water, separates the furnace coil 3 from the pressed-on lamination packet. In the case of a force F acting upon the middle part 13 of the back wall, the following equation applies:

$$F=p\cdot A,$$

where A stands for the contact surface area between the lamination packet and the insulation 12 and p stands for the pressure exerted upon the insulation 12, the furnace coil and the lamination packet.

As can be seen from FIG. 3, side parts 14, 15 of the back wall of the supporting body 8 adjacent the middle part 13 are not curved cylindrically but instead are each constructed as oblique surfaces at an increasing distance from the furnace coil 3. An acute angle beta, preferably 45°, thus forms between the side part 14 of the back wall and a side wall 17 of the supporting body 8 and between the side part 15 of the back wall and a side wall 16 of the supporting body 8. This special embodiment of the back wall of the supporting body 8 which is split into three parts, and a main surface of the lamination packet that has a shape being sectioned into three parts, means that only the single laminations in the middle region of the lamination packet 9 that are in contact with the middle part 13 of the back wall are pressed against insulation 12 and thus against the furnace coil 3 and are therefore operative for the force F, while the edges of the single laminations of the lamination packet 9 that are in contact with the side parts 14, 15 of the back wall have an increasing distance from the furnace coil 3 toward the borders of the lateral regions of the lamination packet.

This forms acute-angled sectors in both peripheral regions of the lamination packet parallel to the furnace axis, which peripheral regions point toward the furnace coil 3. Suitably, the width of the side walls 16, 17 of the supporting body 8 is equivalent to the width b of a single lamination, so that the sectors need not be restricted by the supporting body. The lamination packet also has three main surfaces not facing toward the furnace coil, which are clasped by the supporting body.

Figure 4:
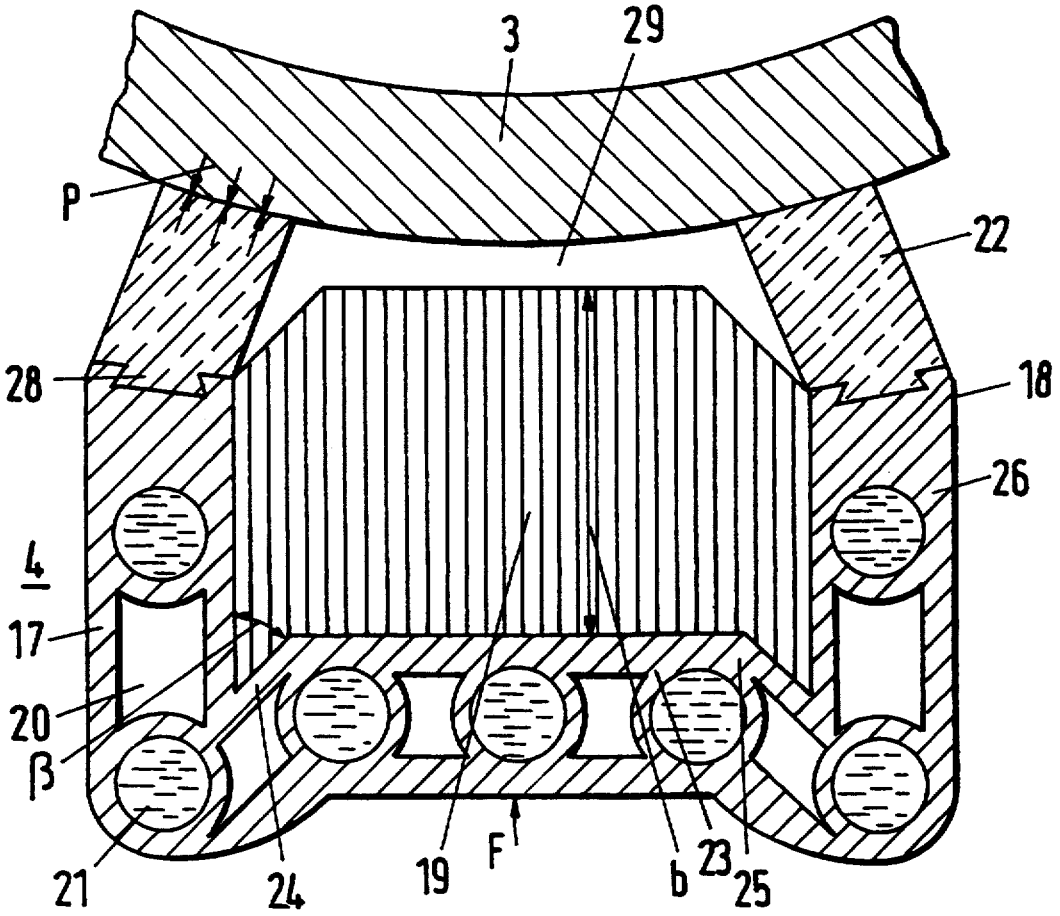
FIG. 4 is a view similar to FIG. 3 of a second fundamental embodiment of a magnetic yoke.

FIG. 4 shows a second fundamental embodiment of a magnetic yoke in section. Once again, a supporting body 18 with a back wall that is split into three parts and side walls 26, 27, is provided. The back wall again has a middle part 23 and two side parts 24, 25. Unlike the middle part 13 of FIG. 3, the middle part 23 need not be curved cylindrically but instead may be entirely flat. The side parts 24, 25 are again constructed as oblique surfaces with respect to the middle part 23 and form the angle beta with the side walls 26, 27. A plurality of longitudinal conduits 20, and in particular internal cooling conduits 21, are again located inside the supporting body 18.

The essential difference between the variant of FIG. 4 and the variant of FIG. 3 is that the force F acting upon the supporting body 18 acts upon the furnace coil 3 through end surfaces of the side walls 26, 27 and insulating blocks 22, rather than through the lamination packet 19. The insulating blocks 22, which are formed of an electrically insulating and vibration-damping material, are secured to the end surfaces of the side walls 26, 27 with a securing device in the form of dovetail-like grooves 28. In this variant, a drainage distance 28 is advantageously formed between the furnace coil 3 and the lamination packet 19. On one hand, it assures the necessary electrical insulation between the furnace coil and the lamination packet, and on the other hand it assures that water will be drained away.

Figure 5:
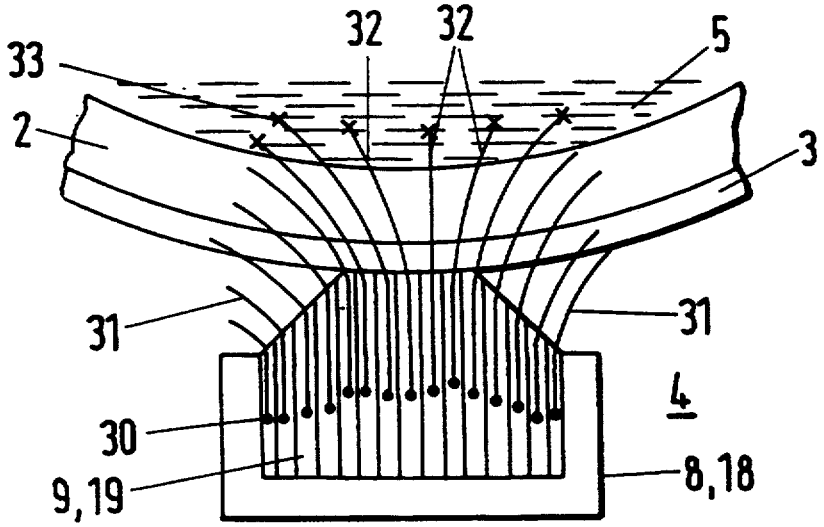
FIG. 5 is a fragmentary, elevational view showing the fundamental course of the magnetic flux in an end region of a lamination packet at a transition from the magnetic yoke to the melt in the crucible.

FIG. 5 shows the basic course of the magnetic flux in the end region of the lamination packet at the transition from the magnetic yoke 4 to the melt 5 in the crucible. The magnetic flux emerges from the ends of the lamination packet 9, 19 and extends through the crucible 2 to the melt 5 or metal starting material. The magnetic flux in the lamination packet is identified by reference numeral 30, the flux of the transverse field in the peripheral region of the furnace coil or crucible by reference numeral 31, the flux of the normal field in the peripheral region of the furnace coil or crucible by reference numeral 32, and the flux in the metal starting material or melt by reference numeral 33.

Due to the shielding effect of the supporting body 8, 18, which is of an electrically conductive material (preferably an aluminum alloy), the flux in the shielded region is prevented from entering or leaving transversely to the longitudinal axis of the lamination packet 9, 19, thereby averting additional losses. The angling of the lamination packet near the side walls of the supporting body produces acute-angled sectors with a relatively large outlet surface area for the magnetic flux 31 of the transverse field, and excess spot heating in the lamination packet and supporting body from high flux concentration is avoided. The magnetic flux 31 is able to enter and emerge from the edges of the single laminations, without additionally having to penetrate other individual laminations. In the case of the flux 32 of the normal field, the lamination packet is located quite close to the coil 3, except for the drainage distance 29 or the distance dictated by the insulation 12. The individual laminations in the lateral region of the lamination packet, which are especially advantageously disposed for the flux 31 of the transverse field, are moreover also suitable for guiding the flux 32 of the normal field.

I claim:

1. In an induction crucible furnace having a longitudinal furnace axis and a furnace coil disposed about the longitudinal furnace axis generating magnetic flux, a magnetic yoke comprising:

a barlike lamination packet for guiding the magnetic flux, said lamination packet having a middle region and two lateral regions adjacent said middle region and having borders facing away from said middle region, a plurality of individual single laminations disposed adjacent one another and forming said lamination packet, said individual laminations having edges and being electrically insulated from one another, and a main surface formed of the edges of said individual laminations facing the furnace coil, said main surface having a shape sectioned into three parts for positioning said middle region relatively close to the furnace coil and defining a distance between the edges of said individual laminations and the furnace coil increasing in said two lateral regions toward said borders for defining two peripheral regions facing toward the furnace coil and having acute-angled, lamination-free sectors being parallel to a longitudinal furnace axis.

2. The yoke according to claim 1, wherein said lamination packet has three main surfaces not facing toward the furnace coil, and including a supporting body clasping said three main surfaces and having a C or U-shaped cross section.

3. The yoke according to claim 2, wherein said supporting body has two side walls and a back wall, said back wall is sectioned into one middle part and two side parts, said side parts have oblique surfaces with increased distances from the furnace coil toward said side walls, and each of said side parts form an acute angle with a respective one of said side walls.

4. The yoke according to claim 3, wherein said acute angle is 45°.

5. The yoke according to claim 3, wherein said middle part of said back wall of said supporting body has a cylindrically curved inner surface in contact with said lamination packet, said inner surface having a radius being adapted to the radius of the furnace coil.

6. The yoke according to claim 3, including insulating blocks formed of an electrically insulating material, each of said side walls of said supporting body having a device for securing one of said insulating blocks.

7. The yoke according to claim 6, wherein said insulating blocks secured to said side walls of said supporting body project beyond said lamination packet and define a drainage distance between the furnace coil and said lamination packet with the yoke pressed against the furnace coil.

8. The yoke according to claim 2, wherein said supporting body is formed of a material with good electrical conductivity.

9. The yoke according to claim 2, wherein said supporting body is formed of a material selected from the group consisting of aluminum and an aluminum alloy.

10. The yoke according to claim 2, wherein said supporting body has at least one longitudinal conduit formed therein.

11. The yoke according to claim 2, wherein said supporting body has at least one longitudinal conduit formed therein for carrying a coolant.

12. The yoke according to claim 2, wherein said supporting body is constructed in one piece.

13. The yoke according to claim 2, wherein said supporting body includes at least one extrusion molded profile.

14. The yoke according to claim 2, wherein said supporting body is deflection and torsion-resistant.

* * * * *